US006155007A

United States Patent [19]

Murase

[11] Patent Number: 6,155,007

[45] Date of Patent: Dec. 5, 2000

[54] SURFACE TREAD FOR A SPIRAL STAIRCASE

[76] Inventor: Masaki Murase, 18-505 Abanrature-siga 4-60-22 Shiga-cho Kita-ku, Nagoya-shi, Aichi-ken, Japan

[21] Appl. No.: 09/014,637

[22] Filed: Jan. 28, 1998

[51] Int. Cl.[7] ..... E04F 11/032

[52] U.S. Cl. ..... 52/187; 52/188; 52/182

[58] Field of Search ..... 52/187, 188, 191, 52/182

[56] References Cited

U.S. PATENT DOCUMENTS

| | | | |
|---|---|---|---|
| 4,722,374 | 2/1988 | Bond | 52/187 X |
| 4,850,164 | 7/1989 | McLeod | 52/187 X |
| 4,865,311 | 9/1989 | Beekenkamp | 52/187 X |

*Primary Examiner*—Beth A. Stephan
*Assistant Examiner*—Brian E. Glessner
*Attorney, Agent, or Firm*—Jordan and Hamburg LLP

[57] ABSTRACT

A spiral staircase includes a newel post and a plurality of steps which are mounted around the newel post. Each step has a surface tread. The tread is set up higher than the inner side. The slope of the tread at the outer side of the tread is sharper than at the inner side of the tread.

6 Claims, 1 Drawing Sheet

SURFACE TREAD FOR A SPIRAL STAIRCASE

BACKGROUND OF THE INVENTION

The invention described herein relates to a surface tread for a spiral staircase and, in particular a spiral staircase featuring a tread in which the outer side is more than the inner side.

A spiral staircase of conventional design is comprised of a newel post and a plurality of steps which are mounted around the newel post. When a user ascends a spiral staircase, a centripetal force is generated, and acts on the user as a result of walking around the newel post.

SUMMARY OF THE INVENTION

It is an object of the invention to decrease the centripetal force which is generated, by the user by Provision of a thread raised on the outer side more than the inner side thereof.

DESCRIPTION OF THE PREFERRED EMBODIMENT

Figure 1:
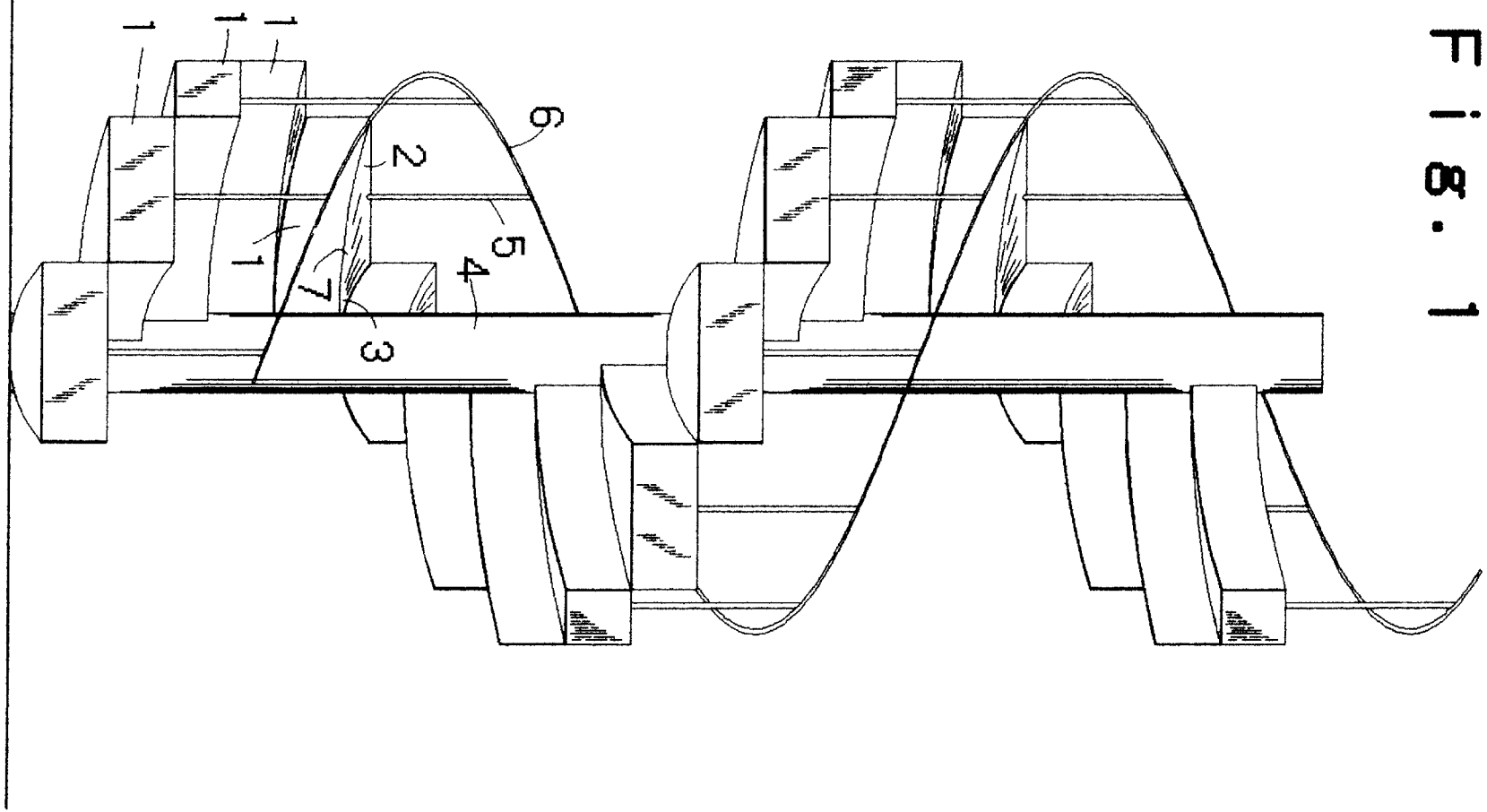
FIG. 1 is a perspective view of the spiral staircase in accordance with an embodiment of the invention.

FIG. 1 shows a spiral staircase in accordance with an embodiment of the present invention. The spiral staircase comprises a newel post 4 a plurality of steps 1, a plurality balusters 5, and a handrail 6. Steps 1 have a surface tread 7. Steps 1 are mounted around a newel post 4. Each surface tread 7 has an outer side 2 and an inner side 3. The outer side 2 of the surface tread 7 is set up higher than inner side 3 of the surface tread 7. The slope of the outer side 2 of the tread 7 is sharper than inner side 4 of the surface tread 7.

Next, the action of the staircase employing the above-mentioned construction is expained. When people step on the tread, weight is exerted on the tread 7, and the footplate generates a reaction. Centrifugal force is composed of power of weight and reaction. Therefore, the centrifugal force which a user generates is decreased.

Of course it will be understood that various alternative and modified embodiments other than those above described, are contemplated and such would certainly also occur to those versed in the art once apprised of the invention disclosed herein. Accordingly, it is the intent that the invention be construed broadly and limited only by the scope of the claims appended hereto.

What is claimed:

1. A spiral staircase, comprising:

steps arranged in a spiral configuration and supported in space about a vertical support, each of said steps including an upper surface defining a surface tread for receiving weight of a user when stepped upon, said surface tread including an inner side located proximal to said vertical support and an outer side located outwardly distant of said vertical support, said outer side being disposed in a raised vertical position relative a vertical position of said inner side.

2. A spiral staircase according to claim 1, wherein a slope presented by said surface tread at the outer side is sharper than at said inner side.

3. A spiral staircase, comprising:

steps arranged in a generally spiral configuration and supported in space about a vertical axis, each of said steps including an upper surface for bearing a weight of a user, said upper surface presenting a surface tread, said surface tread including an inner side located proximal to said vertical axis and an outer side located radially outwardly of said vertical axis, said surface tread being higher at said outer side than at said inner side.

4. A spiral staircase according to claim 3, wherein a slope of said surface tread in a direction extending between said inner side and said outer side increases in a direction approaching said outer side from said inner side.

5. A spiral staircase, comprising:

steps arranged in a generally spiral configuration and supported in space about a vertical axis, each of said steps including a tread disposed on an upper surface of the steps, each said tread including an inner side corresponding in position to the vertical axis and an outer side on a side of the tread radially outward of the vertical axis, said tread of at least one of said steps being higher at said outer side than at said inner side.

6. A spiral staircase according to claim 5, wherein a slope of said tread in a direction extending between said inner side and said outer side increases as a function of a radial distance from said vertical axis.

* * * * *